US006658998B1

(12) United States Patent
Vuolle-Apiala et al.

(10) Patent No.: US 6,658,998 B1
(45) Date of Patent: Dec. 9, 2003

(54) CONTINUOUSLY OPERATING DEVICE FOR DIRECTING PRESSING OR PULLING FORCE AT AN OBJECT FED IN RELATION TO THE DEVICE

(76) Inventors: Antti Vuolle-Apiala, Tuomaankuja 3 A 2, Fin-42300, Jamsankoski (FI); Pekka Tiittanen, Oravasaarentie 298, Fin-40800, Vaajakoski (FI)

( * ) Notice: Subject to any disclaimer, the term of this patent is extended or adjusted under 35 U.S.C. 154(b) by 0 days.

(21) Appl. No.: 10/019,845

(22) PCT Filed: Apr. 20, 2000

(86) PCT No.: PCT/FI00/00343

§ 371 (c)(1),
(2), (4) Date: May 28, 2002

(87) PCT Pub. No.: WO00/62985

PCT Pub. Date: Oct. 26, 2000

(30) Foreign Application Priority Data

Apr. 20, 1999 (FI) ..... 990880

(51) Int. Cl.[7] ..... B30B 3/06
(52) U.S. Cl. ..... 100/161; 100/176
(58) Field of Search ..... 100/161, 155 R, 100/176, 327

(56) References Cited

U.S. PATENT DOCUMENTS 4,356,764 A * 11/1982 Haugen ..... 100/169
5,113,884 A * 5/1992 Melgeorge ..... 134/112 R

FOREIGN PATENT DOCUMENTS

| | | |
|---|---|---|
| FI | 921067 | * 12/1992 |
| FI | 90321 | 10/1993 |
| SE | 173 929 | 1/1961 |

* cited by examiner

*Primary Examiner*—Allen Ostrager
*Assistant Examiner*—Shelley Self
(74) *Attorney, Agent, or Firm*—Bachman & LaPointe, P.C.

(57) ABSTRACT

The invention relates to a continuously operating device for directing pressing or pulling force at an object fed in relation to the device, at that part of the object which is at the location of the device, by using the at least two pairs of rolls or the like belonging to the device, which are at a distance from one another in the direction of movement of the object and through the nips between which the object is arranged to travel, whereby to at least one roll of at least one pair of rolls is connected, supported on the roll and thus rotating with the roll, an actuator effecting a rotary movement concentric with respect to the axis of rotation of the roll, the actuator being in turn arranged to transmit the rotary movement by mechanical power transmission means to at least one roll of the other pair of rolls. For supplying the driving power of the actuator is arranged a drive shaft which is arranged to rotate concentrically with respect to the axis of rotation of the roll, but independently with respect to the axis of rotation, and which drive shaft is, on the other hand, arranged to be rotated by a power means.

7 Claims, 1 Drawing Sheet

CONTINUOUSLY OPERATING DEVICE FOR DIRECTING PRESSING OR PULLING FORCE AT AN OBJECT FED IN RELATION TO THE DEVICE

BACKGROUND OF THE INVENTION

The invention relates to a continuously operating device for directing pressing or pulling force at an object fed in relation to the device, at that part of the object which is at the location of the device, by using the at least two pairs of rolls or the like belonging to the device, which are at a distance from one another in the direction of movement of the object and through the nips between which the object is arranged to travel, whereby to at least one roll of at least one pair of rolls is connected, supported on the roll and thus rotating with the roll, an actuator effecting a rotary movement concentric with respect to the axis of rotation of the roll, the actuator being in turn arranged to transmit the said rotary movement by mechanical power transmission means to at least one roll of the other pair of rolls.

SUMMARY OF THE INVENTION

The type of device mentioned above is known from the Finnish patent 90321 (Vuolle-Apiala). The hydraulic hoses between the hydraulic motor rotating with the roll and the hydraulic aggregate fitted solidly in place outside the roll and acting as the power source of the hydraulic motor are provided with connecting slides due to the parts rotating with respect to one another. Components such as these limit the permitted hydraulic pressure to a relatively low level, which means that sufficiently strong pressing or pulling forces cannot be obtained in all cases.

The object of the invention is to eliminate such disadvantages limiting the hydraulic pressure in known solutions and to achieve a continuously operating device for directing pressing or pulling force at an object or the like fed in relation to the device, which device is structurally as simple as possible, economically priced and consumes little energy, and which device can be used, among others, as a continuously operating press when making finger joints and, for example, as a part of a continuously operating strength-grading device for timber or other similar testing apparatus To achieve this object it is characteristic of the device relating to the invention that a drive shaft is provided for supplying the driving power of the actuator, which shaft is arranged to rotate concentrically with respect to the axis of rotation of the roll, but independently with respect to the said axis of rotation, and which drive shaft is, on the other hand, arranged to be rotated by a power means.

Further preferable developments of the invention are described in the dependent claims.

BRIEF DESCRIPTION OF THE DRAWINGS

The invention is described in greater detail in the following, with reference to the appended drawing, in which.

DETAILED DESCRIPTION OF THE PREFERRED EMBODIMENTS

Figure 1:
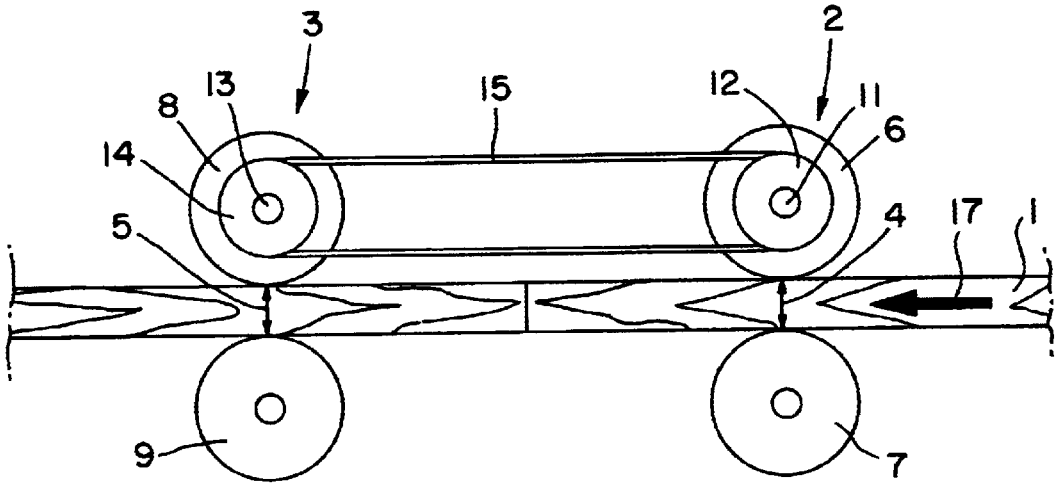
FIG. 1 shows a diagrammatic side view of the device relating to the invention.
Figure 2:
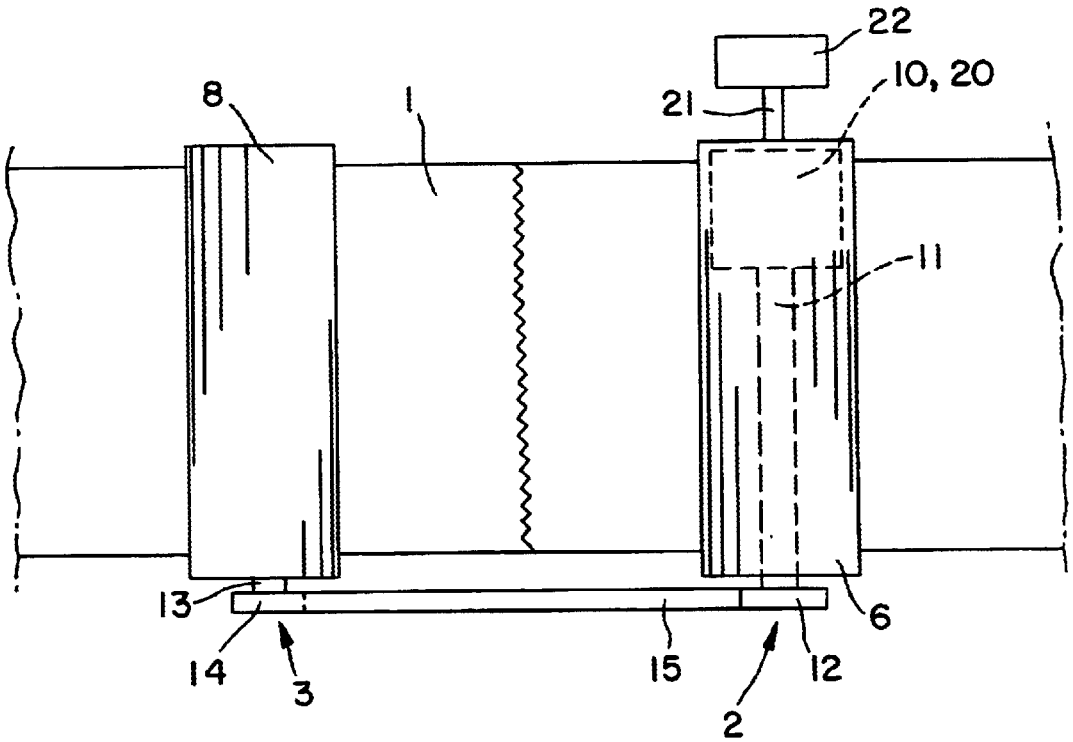
FIG. 2 shows a diagrammatic top view of the device relating to the invention.

By means of the device shown diagrammatically in FIGS. 1 and 2, a pressing or pulling force parallel with the direction of movement of the object is directed at the object 1 being fed from right to left in the Figures. The device comprises two pairs of rolls 2, 3 which are at a distance from one another and through the nips 4, 5 between which the object 1 travels. Each pair of rolls 2, 3 is arranged to direct an adjustable pressing force at the object 1 in the nip 4, 5, essentially perpendicularly to the direction of movement 17. The pressing or pulling force parallel with the direction of movement 17 is thus directed at the section between the nips 4, 5 which is parallel with the direction of movement 17 of the object (1).

The pair of rolls 2 comprises an upper roll marked with reference numeral 6 and a lower roll marked with reference numeral 7. Similarly, the pair of rolls 3 comprises an upper roll marked with reference numeral 8 and a lower roll marked with reference numeral 9. It is naturally obvious that instead of the individual rolls 6–9 can be used, for example, groups formed by several rolls, which groups may direct the force at the object 1 via a roll belt.

It should be emphasised that instead of the rolls 6–9 can also be used different types of wheels, for example, rubber wheels.

The rolls 6–9 of the pairs of rolls are fitted with bearings in a manner known as such with respect to the frame part of the device and thus the bearings will not be discussed in this respect in this connection and nor are they shown in the drawing.

To the roll 6 is connected, supported on the roil 6 and thus rotating with the roll, an actuator 10 effecting a rotary movement concentric with respect to the axis of rotation of the roll 6. The actuator 10 is in turn arranged to transmit the said rotary movement by mechanical power transmission means 11–15 to at least one roll 8 of the other pair of rolls 3.

A drive shaft 21 is provided for supplying the driving power of the actuator 10, which shaft is arranged to rotate concentrically with respect to the axis of rotation of the roll, but independently with respect to the said axis of rotation, and which drive shaft 21 is, on the other hand, arranged to be rotated by a power means 22.

The actuator 10 is preferably arranged inside the roll 6 and the power means 22 outside the roll.

The actuator 10 is preferably comprised of a hydraulic motor and a hydraulic pump connected to it and rotating coaxially with it. Alternatively, the actuator 10 may also be comprised of a mechanical gear which is most conveniently also fitted inside the roll 6.

The power means 22, which is most conveniently placed in a fixed and stationary manner outside the roll 6, is preferably comprised of an electric motor, hydraulic motor or pneumatic motor.

In a preferred embodiment of the invention the actuator 10 is comprised of a combination of a hydraulic motor and a hydraulic pump. The frame parts of the hydraulic motor 10 and the hydraulic pump 20 are attached in a fixed manner to each other and, in addition, connected to the mantle or end surface of the roll 6, whereby the said frame parts will rotate together with the roll 6. The shaft 11 of the hydraulic motor 10 forms at the same time the axis of rotation of the roll 6 or a part of it and is arranged to project from the end of the roll 6. The roll 6 is fitted with bearings in such a way that it is able to rotate freely with respect to the shaft 11. The drive shaft 21 rotating the hydraulic pump is arranged to project from the opposite end surface of the roll 6 with respect to the shaft 11, coaxially with the axis of rotation of the roll 6, whereby the drive shaft 21 is arranged to be rotated by an electric motor 22. The electric motor 22 thus rotates a hydraulic pump which in turn provides the driving power for the hydraulic motor.

Between the electric motor 22 and the hydraulic pump power transmission takes place by means of a mechanical shaft 21 and between the hydraulic pump and hydraulic motor via fixed liquid channels. In power transmission are thus not required special components which would limit the highest permitted service pressure. The same applies when the actuator 10 is a mechanical gear.

Especially when using an electric motor as the power means 22, the power means 22 can then also be located inside the roll 6, which means that the electric current can be conducted to the electric motor via slide switches. It is, however, most recommendable to fit the electric motor outside the roll 6.

To the end of the joint shaft 11 of the roll 6 and the actuator 10 outside the roll 6 is connected a chain wheel 12 and, correspondingly, on the roll shaft 13, which roll 8 and shaft 13 form an integrated whole, is connected a chain wheel 14 The chain wheels 12 and 14 are connected to each other by means of a chain 15.

The operation of the device is as follows.

When an object 1 is fed in the direction of the arrow 17 through the nips 4, 5, the rolls 6–9 rotate essentially in such a manner that their circumferential speed corresponds to the feeding rate of the object 1. When the electric motor 22 rotates the hydraulic pump, which in turn transmits the power to the hydraulic motor 10, the frame part of which is thus supported on the roll 6 and rotates with it, the hydraulic motor 10 effects a rotating force on the shaft 11, which is transmitted via he chain 15 as a rotating force directed at the roll 8. The force thus directed at the roll 8 may act either in a direction parallel with the direction of rotation of the roll 8 or in a direction opposite to the direction of rotation. In the first mentioned case, a pulling force is directed at the part of the object 1 between the nips 4, 5, and in the latter case a pressing force. Pressing or pulling is selected simply by changing the direction of rotation of the hydraulic motor 10 and the intensity of the pressing or pulling force by adjusting the output of the motor 10. To adjust the pressing or pulling force, the hydraulic pump is provided with control means for achieving the desired output pressure. Alternatively, especially when using a mechanical gear 10, the power is adjusted by the control means provided in the power means 22 by adjusting the speed of rotation of the shaft 21.

The output required by the device is very low because the pairs of rolls 2, 3 generate forces, of which the majority are cancelled out as internal forces directed at the object 1. Therefore, in order to feed the object 1, in addition to the usual frictional forces, only the difference between the forces directed by the rolls 6 and 8 at the object 1 must be overcome.

What is claimed is:

1. A continuously operating device for directing pressing or pulling force at an object fed in relation to the device, at that part of the object which is at the location of the device, said device comprising: at least two pairs of roller means, said pairs of roller means being located at a distance from one another in a direction of movement of the object, each said pair of roller means creating a nip, each said roller means in each said pair of roller means having an axis of rotation, an actuator connected to and supported by at least one roller means of at least a first one of said pairs of roller means, said actuator rotating with said at least one roller means for which the object is arranged to travel, effecting a rotary movement concentric with respect to the axis of rotation of the at least one roller means, the actuator being arranged to transmit said rotary movement and a rotary force by mechanical power transmission means to at least one roller means of another pair of said roller means, a drive shaft for supplying driving power of the actuator, said drive shaft arranged to rotate concentrically with respect to the axis of rotation of the at least one roller means of the first one of said roller pairs, but independently with respect to the axis of rotation, said drive shaft being rotated by a power means, and said rotary force transmitted by said actuator as a result of the driving power supplied by said independently acting drive shaft to said actuator acting in a first mode in a first direction parallel with a direction of rotation of said at least one roller means to effect said pulling force and acting in a second mode in a second direction in opposition to said direction of rotation of said at least one roller means to effect said pressing force.

2. A device as claimed in claim 1, wherein the actuator is comprised of a hydraulic motor and a hydraulic pump connected to the hydraulic motor and rotating coaxially with the hydraulic motor.

3. A device as claimed in claim 2, wherein the hydraulic pump is provided with control means for achieving a desired output pressure.

4. A device as claimed in claim 1, wherein the actuator is comprised of a mechanical gear.

5. A device as claimed in claim 1, wherein the actuator is arranged inside said at least one roller means of the first one of said roller pairs and the power means is located outside said at least one roller means of the first one of said roller pairs.

6. A device as claimed in claim 1, wherein the power means is comprised of at least one of an electric motor, a hydraulic motor, and a pneumatic motor.

7. A device as claimed in claim 1, wherein the power means is provided with control means for adjusting the speed of rotation of the drive shaft.

* * * * *